US007307054B2

(12) United States Patent
Bateman

(10) Patent No.: US 7,307,054 B2
(45) Date of Patent: Dec. 11, 2007

(54) VAPOR COMPRESSION AIR CONDITIONING OR REFRIGERATION SYSTEM CLEANING COMPOSITIONS AND METHODS

(75) Inventor: David J. Bateman, Claymont, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 317 days.

(21) Appl. No.: 11/039,625

(22) Filed: Jan. 19, 2005

(65) Prior Publication Data

US 2005/0199853 A1 Sep. 15, 2005

Related U.S. Application Data

(60) Provisional application No. 60/538,009, filed on Jan. 20, 2004.

(51) Int. Cl.
*C11D 7/50* (2006.01)

(52) U.S. Cl. ..... 510/417; 252/175

(58) Field of Classification Search ..... None
See application file for complete search history.

(56) References Cited

U.S. PATENT DOCUMENTS

| | | | | |
|---|---|---|---|---|
| 5,202,044 | A | 4/1993 | Hagihara et al. | |
| 5,711,165 | A | 1/1998 | Iizuka et al. | |
| 6,162,304 | A | 12/2000 | Weidman et al. | |
| 6,326,338 | B1 * | 12/2001 | Garrett | 508/589 |
| 6,403,540 | B1 * | 6/2002 | Richardson | 508/440 |
| 6,699,829 | B2 | 3/2004 | Doyel et al. | |
| 2002/0007640 | A1 | 1/2002 | Corr et al. | |

FOREIGN PATENT DOCUMENTS

| | | | |
|---|---|---|---|
| EP | 1 354 985 | A1 | 10/2003 |
| JP | 1993017789 | A | 1/1993 |
| JP | 1993331474 | A | 12/1993 |
| JP | 1994025682 | A | 2/1994 |
| JP | 1994025683 | A | 2/1994 |
| JP | 1994108076 | A | 4/1994 |
| JP | 1994234998 | A | 8/1994 |
| WO | WO 90/12849 | | 11/1990 |
| WO | WO 00/44859 | | 8/2000 |
| WO | WO 01/74977 | A2 | 10/2001 |

OTHER PUBLICATIONS

International Search Report, date of mailing: Sep. 22, 2006.
Written Opinion of the International Searching Authority, date of mailing: Sep. 22, 2006.

* cited by examiner

*Primary Examiner*—Gregory Webb
(74) *Attorney, Agent, or Firm*—Chyrrea J. Sebree; Jane O. Hamby

(57) ABSTRACT

The present invention relates to compositions that are suitable for removing or reducing residue from a vapor compression air conditioning or refrigeration system consisting essentially of 1,1,1,2,2,3,4,5,5,5-decafluoropentane and polyol ester, and methods of using the composition.

9 Claims, No Drawings

VAPOR COMPRESSION AIR CONDITIONING OR REFRIGERATION SYSTEM CLEANING COMPOSITIONS AND METHODS

CROSS REFERENCE TO RELATED APPLICATION

This application claims the priority benefit of U.S. Provisional Application 60/538,009, filed Jan. 20, 2004.

FIELD OF THE INVENTION

The present invention relates to compositions and methods for cleaning lubricated vapor compression systems.

BACKGROUND OF THE INVENTION

There is a need to clean lubricated vapor compression systems and their components during manufacture and service.

Vapor compression air conditioning and refrigeration systems are well known in the art. They are used in a wide variety of applications such as heating, air conditioning, and refrigeration. By compressing and expanding a heat transfer agent or refrigerant, these systems absorb and release heat according to the needs of a particular application. Common components of a vapor compression system include: vapor or gas compressors; liquid pumps; heat-transfer equipment such as gas coolers, intercoolers, aftercoolers, heat exchangers, economizers; vapor compressors, such as reciprocating piston compressors, rotating screw compressors, centrifugal compressors, and scroll compressors; evaporators; liquid coolers and receivers; expanders; control valves and pressure-drop throttling devices such as capillaries and orifice tubes; refrigerant-mixture separating chambers; and connecting piping and insulation. These components are typically fabricated from aluminum, copper, brass, steel, various plastics and conventional gasket and O-ring materials.

Since vapor compression systems have sliding, rotating or other moving components, most require the use of a lubricant which is mixed with the refrigerant. There is a need from time to time to clean such systems and their components by removing the lubricants as well as other contaminants and debris from their surfaces. Such a need arises, for example, during the retrofit of a chlorofluorocarbon (CFC) to a hydrochlorofluorocarbon (HCFC) or hydrofluorocarbon (HFC), or retrofit of a HCFC refrigerant to a HFC refrigerant, and during service, especially after a catastrophic event such as compressor burnout or mechanical failure.

Until recently, CFCs, such as trichloromethane (R-11), and HCFCs, such as 1,1-dichloro-1-fluoroethane (HCFC-141 b), were used as cleaning agents for such systems. Although effective, CFCs and HCFCs are now considered environmentally unacceptable because they are believed to contribute to the depletion of the stratospheric ozone layer. As the use of CFCs and HCFCs is reduced and ultimately phased out, new cleaning agents are needed that not only perform well, but also pose no danger to the ozone layer.

A number of environmentally acceptable solvents have been proposed, but their use has been met with limited success. For example, organic solvents, such as hexane, have good cleaning properties and do not deplete the ozone layer, but they are flammable. Aqueous-based cleaning compositions have zero ozone depletion potential and are non-flammable, but they tend to be difficult to remove from the cleaned surfaces due to their relatively low volatility and the presence therein of additives that leave a residue. Additionally, aqueous-based cleaning compositions are often inadequate for cleaning typical organic soils that are present in vapor compression systems. Terpene-based solvents, like aqueous-based cleaning compositions, are difficult to remove from the system.

Therefore, a need exists for the identification of environmentally-acceptable cleaning agents that effectively clean vapor compression systems. The present invention fulfills this need.

BRIEF SUMMARY OF THE INVENTION

Disclosed herein is a composition for reducing and removing residue from a vapor compression air conditioning or refrigeration system, said composition consisting essentially of 1,1,1,2,2,3,4,5,5,5-decafluoropentane and polyol ester, wherein said polyol ester is selected from esters of neopentyl glycol, glycerol, trimethylol propane, pentaerythritol and carboxylic acids represented by the formula HOC(O)$R^1$, where $R^1$ is a $C_{6-12}$ saturated, cyclic, straight chain or branched hydrocarbon radical.

Also disclosed is a method for reducing residue in a vapor compression air conditioning or refrigeration system, said method comprising: removing substantially all refrigerant and lubricant from said vapor compression air conditioning or refrigeration system, contacting said vapor compression air conditioning or refrigeration system with the composition of the present invention for a period of time sufficient to reduce the amount of residue in said system, and removing said composition from said system.

The present invention further comprises a method for cleaning a component of a vapor compression system, said method comprising the steps of: flushing the component with composition of the present invention; and removing said composition from said component.

DETAILED DESCRIPTION OF THE INVENTION

Vapor compression air conditioning or refrigeration system as used herein refers to a complete system, groupings of components of a system, individual components of a system, or portions of individual components of a system. The present composition and method have utility in removing residue from common compression refrigeration systems including components such as: vapor or gas compressors; liquid pumps; heat-transfer equipment such as gas coolers, intercoolers, aftercoolers, heat exchangers, economizers; vapor compressors, such as reciprocating piston compressors, rotating screw compressors, centrifugal compressors, and scroll compressors; evaporators; liquid coolers and receivers; expanders; control valves and pressure-drop throttling devices such as capillaries and orifice tubes; refrigerant-mixture separating chambers; and connecting piping and insulation. These components are typically fabricated from aluminum, copper, brass, steel, various plastics and conventional gasket and O-ring materials.

Residue removed by the present composition and method may include compressor lubricant and particulates, including decomposed lubricant, metal (for example aluminum, copper, brass, steel particulates from system components), rubbers and plastics (for example, from system hoses and O-rings).

The invention disclosed herein is a flushing or cleaning composition for removing residue from a vapor compression air conditioning or refrigeration system, said composition consisting essentially of 1,1,1,2,2,3,4,5,5,5-decafluoropentane and a polyol ester. The composition may be used as a flushing composition with a flush kit, in a closed-loop system, or in any suitable manner to achieve flushing of a component with the inventive composition.

1,1,1,2,2,3,4,5,5,5-decafluoropentane (HFC-43-10mee, $CF_3CF_2CHFCHFCF_3$) is a commercial product of E. I. du Pont de Nemours and Company, Wilmington, Del., USA.

Polyol esters of the present invention are available commercially from Hatco Co., New Jersey, USA. Polyol esters of the present invention are reaction products of a carboxylic acid and at least one polyol selected from neopentyl glycol, glycerol, trimethylol propane and pentaerythritol. Preferred of the polyols is neopentyl glycol.

Carboxylic acids that are used to produce the polyol esters of the present invention are represented by the formula $HOC(O)R^1$, where $R^1$ is a $C_{6-12}$ saturated, cyclic, straight chain or branched, hydrocarbon radical. Examples of carboxylic acids include 2,2-dimethylpentanoic acid, 2-ethylpentanoic acid, 3-ethylpentanoic acid, 2-methylhexanoic acid, 3-methylhexanoic acid, 4-methylhexanoic acid, 5-methylhexanoic acid, cyclohexanecarboxylic acid, cyclopentylacetic acid, 2-ethylhexanoic acid, 3,5-dimethylhexanoic acid, 2,2-dimethylhexanoic acid, 2-methylheptanoic acid, 3-methylheptanoic acid, 4-methylheptanoic acid, 2-propylpentanoic acid, 3,4-dimethylhexanoic acid, cyclohexylacetic acid, 3-cyclopentylpropionic acid, 2,2-dimethylheptanoic acid, 3,5,5-trimethylhexanoic acid, 2-methyloctanoic acid, 2-ethylheptanoic acid, 3-methyloctanoic acid, 2-ethyl-2,3,3-trimethylbutyric acid, 2,2,4,4-tetramethylpentanoic acid and 2,2-diisopropylpropionic acid, with preference given to 2-methylhexanoic acid, 2-ethylhexanoic acid, 3,5-dimethylhexanoic acid and 3,5,5-trimethylhexanoic acid. Preferred of the carboxylic acids is 2-ethylhexanoic acid.

Preferred polyol esters of the present invention are neopentyl glycol esters that are represented by $C(CH_3)_2(CH_2OC(O)R^1)_2$, wherein each $R^1$ is independently selected from $C_{6-12}$ saturated, cyclic, straight chain or branched, hydrocarbon radicals. $R^1$ is preferably a saturated, branched $C_7$ hydrocarbon radical and most preferably the 1-ethylpentyl radical. A preferred neopentyl glycol ester is neopentyl glycol di-2-ethylhexanoate ($C(CH_3)_2(CH_2OC(O)CH(C_2H_5)(CH_2)_3CH_3)_2$).

The amount of 1,1,1,2,2,3,4,5,5,5-decafluoropentane in the present 1,1,1,2,2,3,4,5,5,5-decafluoropentane and polyol ester composition is from about 5 to about 25 weight percent, preferably about 15 weight percent, with the remainder being polyol ester, based on the total weight of 1,1,1,2,2,3,4,5,5,5-decafluoropentane and polyol ester.

A preferred composition of the present invention consists essentially of about 15 weight percent 1,1,1,2,2,3,4,5,5,5-decafluoropentane and about 85 weight percent neopentyl glycol di-2-ethylhexanoate.

The compositions of the present invention is prepared by adding the weight percentage of each of component to a common vessel, optionally with agitation. The combination yields the composition of the present invention.

The present invention further comprises a method for reducing or removing residue in a vapor compression refrigeration system comprising: removing essentially all refrigerant and lubricant from said vapor compression refrigeration system, contacting said vapor compression refrigeration system with an aforementioned 1,1,1,2,2,3,4,5,5,5-decafluoropentane and polyol ester composition for a period of time sufficient to reduce the amount of residue in said system, and removing said composition from said system.

The present invention further comprises a method for cleaning a component of a vapor compression system comprising the steps of: flushing the component with an aforementioned 1,1,1,2,2,3,4,5,5,5-decafluoropentane and polyol ester composition, and removing said composition from said component.

In use, a composition of the present invention may be first applied to the surface of a component of the lubricated vapor compression system. The application techniques are known in the art, and include exposing the composition in the liquid form to the component or system. Next, the cleaning composition is removed from the component or system by the use of pressurized air or nitrogen.

Suitable cleaning techniques include degreasing a particular component or flushing the system. Degreasing particular components can be performed in an open or closed degreasers. Such cleaning apparatus is well known in the art. Various procedures used for flushing a component are well known in the art. For example, a component or a series of components is flushed by pumping the cleaning composition through the component. After the component is flushed, the cleaning composition can be removed from the component by blowing nitrogen gas, or other gas, through the component. Other suitable cleaning procedures can also be used to contact the cleaning composition of the present invention with the surfaces to be cleaned. In practice, the present methods may be carried out as described herein.

One may employ a method using a flush method. In using this method one will recover refrigerant and lubricant from the air conditioning or refrigeration system, and disconnect the inlet and outlet of the component that is to be cleaned or flushed from the system. The method is carried out by injecting a suitable composition, such as the composition of the present invention, using a flush kit. Generally, a flush kit includes a pressurized vessel containing the flushing composition, a nozzle for providing the composition to the component to be flushed, along with suitable connecting hoses, and air or nitrogen or other suitable gas to facilitate dispensing of the flushing composition from the vessel. Such flush kits are available commercially from FJC, Inc. Mooresville, N.C., USA. Alternatively, one may use a closed loop method. In this method, one will recover refrigerant and lubricant from the air conditioning or refrigeration system and disconnect the inlet and outlet of the component that is to be cleaned or flushed from the system. When using a closed loop method, the cleaning is achieved using a suitablclosed loop apparatus. Generally, these closed loop apparatuses include a reservoir of suitable volume, equipped with a pump (operated by air, electricity or other suitable means), hoses, filters, etc. Such closed loop apparatuses are commercially available, for example, from Cliplight Co. in Toronto, Ontario Canada. The hoses that are connected to the closed loop apparatus are connected to the inlet/outlet of the component that is to cleaned or flushed. The flushing composition is circulated through the component from the reservoir for about 30 minutes, or a time sufficient to reduce or remove the residue in the component. The component is then purged with dry air or nitrogen for about 30 to about 60 minutes to remove any flushing composition that may remain in the component. The flushing composition may be used more than once if the closed loop system is equipped with suitable filters and/or separators, etc.

What is claimed is:

1. A composition for removing residue from a vapor compression air conditioning or refrigeration system, said composition consisting essentially of about 15 weight percent 1,1,1,2,2,3,4,5,5,5-decafluoropentane and about 85 weight percent neopentyl glycol di-2-ethylhexanoate.

2. A method for removing or reducing residue in a vapor compression air conditioning or refrigeration system, said method comprising:

removing essentially all refrigerant and lubricant from said vapor compression system, contacting said vapor compression system with a composition of consisting essentially of from about 5 to about 25 weight percent 1,1,1,2,2,3,4,5,5,5-decafluoropentane and from about 75 to about 95 weight percent polyol ester for a period of time sufficient to reduce the amount of residue in said system, and removing said composition from said system.

3. A method for cleaning a component of a vapor compression air conditioning or refrigeration system comprising the steps of flushing the component with a composition consisting essentially of from about 5 to about 25 welch percent 1,1,1,2,2,3,4,5,5,5-decafluoropentane and from about 75 to about 95 weight percent polyol ester; and removing said composition from said component.

4. A composition for removing residue from a vapor compression air conditioning or refrigeration system, said composition consisting essentially of from about 5 to about 25 weight percent 1,1,1,2,2,3,4,5,5,5-decafluoropentane and from about 75 to about 95 weight percent polyol ester.

5. The composition of claim 4 consisting essentially of about 15 weight percent 1,1,1,2,2,3,4,5,5,5-decafluoropentane and about 85 weight percent polyol ester.

6. The composition of claim 4 wherein said polyol ester is a reaction product of a carboxylic acid and at least one polyol selected from the group consisting of neopentyl glycol, glycerol, trimethylol propane and pentaerythritol.

7. The composition of claim 4 wherein said polyol ester is a neopentyl grycol ester represented by the formula $C(CH_3)_2(CH_2OC(O)R^1)_2$, wherein each $R^1$ is independently selected from $C_{6-12}$ saturated, cyclic, straight chain or branched, hydrocarbon radicals.

8. The composition of claim 7 wherein each $R^1$ is a saturated, branched $C_7$ hydrocarbon radical.

9. The composition of claim 8 wherein each $R^1$ is a 1-ethyl-pentyl radical.

* * * * *